US006357064B1

(12) United States Patent
Totsky

(10) Patent No.: US 6,357,064 B1
(45) Date of Patent: Mar. 19, 2002

(54) ASSIST DEVICE FOR DISABLED PERSONS

(76) Inventor: Donald Totsky, W162 N9732 Mayflower Dr., Germantown, WI (US) 53022

( * ) Notice: Subject to any disclaimer, the term of this patent is extended or adjusted under 35 U.S.C. 154(b) by 0 days.

(21) Appl. No.: 09/742,522

(22) Filed: Dec. 20, 2000

(51) Int. Cl.[7] ..... A61G 7/10
(52) U.S. Cl. ..... 5/86.1; 5/81.1 R; 5/84.1
(58) Field of Search ..... 5/86.1, 81.1 R, 5/81.1 RP, 84.1

(56) References Cited

U.S. PATENT DOCUMENTS

| | | | | |
|---|---|---|---|---|
| 4,279,043 A | | 7/1981 | Saunders | 5/86.1 |
| 4,375,707 A | * | 3/1983 | Boeringer | 5/81.1 R |
| 4,796,313 A | | 1/1989 | DiMatteo et al. | 5/81.1 R |
| 4,847,930 A | * | 7/1989 | Spath | 5/84.1 |
| 4,934,003 A | | 6/1990 | Hayakawa et al. | 5/81.1 R |
| 4,985,947 A | | 1/1991 | Ethridge | 5/81.1 R |
| 5,054,137 A | | 10/1991 | Christensen | 5/81.1 R |
| 5,507,044 A | | 4/1996 | Williamson et al. | 5/81.1 RP |
| 5,509,432 A | | 4/1996 | Peterson | 5/81.1 R |
| 5,524,303 A | | 6/1996 | Palmer, Jr. et al. | 5/81.1 RP |
| 5,526,541 A | | 6/1996 | Massey et al. | 5/81.1 RP |
| 5,560,053 A | * | 10/1996 | Mills | 5/81.1 R |
| 5,983,421 A | | 11/1999 | Walser | 5/81.1 R |
| 6,044,507 A | | 4/2000 | Smith | 5/81.1 R |

FOREIGN PATENT DOCUMENTS

| | | | |
|---|---|---|---|
| GB | 995235 A | * | 6/1965 |

* cited by examiner

*Primary Examiner*—Alexander Grosz
(74) *Attorney, Agent, or Firm*—Ryan Kromholz & Manion, S.C.

(57) ABSTRACT

A device for assisting a disabled person to rise from a bed to a standing position is provided by the invention. The device includes a planar base with a plurality of casters attached to its bottom surface to enable rolling movement of the device across a floor. A support structure which extends vertically from the upper surface of the base is defined by a vertical members and at least one horizontal member connecting the vertical members, the support structure being closed on three sides and open on a fourth side. A pair of mating hinge components are provided for releasably connecting the device to a bed frame thus forming a pivot point. The device is thus pivotable from a position facing the bed for access of a disabled person thereto and is pivotable ninety degrees to enable egress therefrom. A first hinge component is affixed to a vertical member of the support structure adjacent to its open side. A second hinge component is attachable to a bed frame at a height adapted to receive the mating first hinge component. A pin is provided to removably pivotally connect the first and second hinge components.

4 Claims, 2 Drawing Sheets

ASSIST DEVICE FOR DISABLED PERSONS

BACKGROUND OF THE INVENTION

The present invention relates to assist devices for disabled people. More specifically the invention relates to a movable stand which is detachably mounted to the side of a bed to enable a disabled person to stand safely and to be alternatively transported by rolling on wheels provided on the assist device or transferred to a wheelchair.

Various types of transfer stands and equipment to assist disabled people in rising up from a reclining position into a standing or seated position have been proposed. Many such devices are mechanized, thus requiring the presence of knowledgeable trained operators, who are in short supply in most nursing home and hospital situations. Due to cost, such devices are out of the question for use in the average residential setting.

Less expensive devices have been proposed. For example, U.S. Pat. No. 4,279,043 discloses a transfer stand on wheels. The device relies on a braking mechanism to lock the wheels in order to maintain the stand in a stationary position. However such devices have not gained widespread use. One problem which occurs is that a heavy person attempting to stand may lurch and cause the device to tip and as a result sustain an injury. Accordingly, a need has continued to exist for an inexpensive but stable assist devices particularly for assisting disabled persons in rising from a bed to a standing position.

SUMMARY OF THE INVENTION

It is a principal objective of the invention to provide a patient assist device which, while inexpensive and economical, is provided with improved stability and is adaptable for use by persons having a wide variety of disabilities.

An important aspect of the present invention is the provision of an assist device which is pivotally attached to the side or frame of a bed, the connection point on the side of the bed acting as a pivot point. This arrangement enables pivoting of the device against the side of the bed and subsequently, after a ninety degree pivot, allows the patient to either step out of the device or to be seated in a wheelchair or the like.

In accordance with a related aspect of the invention the pivot connection is readily connected to and disconnected from the side of the bed. In accordance with a still further aspect the device can be provided with a pivot connection that is optionally mounted to either side of a bed, thus enabling use by multiple patients for example, if more that one bed is located in a single room. The invention contemplates use of a pin reciprocatably mounted on the device for use in coupling and decoupling the device from the pivot hinge.

In accordance with a further related aspect of the invention, the device can be provided with a sleeve on slidable hinge pin mounted on the device.

Briefly, a device for assisting a disabled person to rise from a bed to a standing position is provided by the invention. The device includes a planar base with a plurality of casters attached to its bottom surface to enable rolling movement of the device across a floor. A support structure which extends vertically from the upper surface of the base is defined by a vertical members and at least one horizontal member connecting the vertical members, the support structure being closed on three sides and open on a fourth side.

A pair of mating hinge components are provided for releasably connecting the device to a bed frame thus forming a pivot point. The device is thus pivotable from a position facing the bed for access of a disabled person thereto and is pivotable ninety degrees to enable egress therefrom. A first hinge component is affixed to a vertical member of the support structure adjacent to its open side. A second hinge component is attachable to a bed frame at a height adapted to receive the mating first hinge component. A pin is provided to removably pivotally connect the first and second hinge components.

The invention will be set forth in greater detail in the claims, the following detailed description and the accompanying drawings.

DETAILED DESCRIPTION OF THE INVENTION

Figure 1:
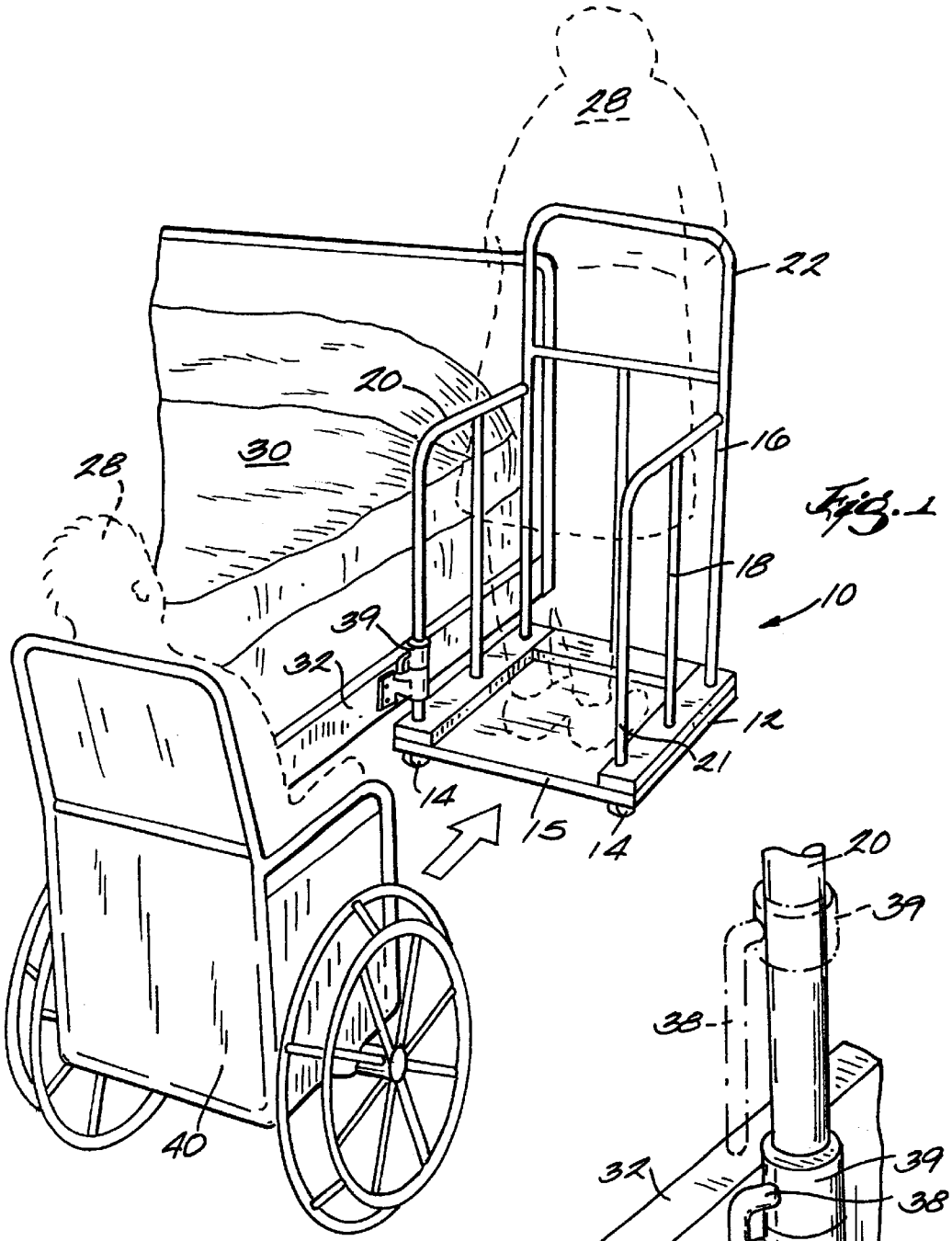
FIG. 1 is a fragmentary perspective view of a device of this invention attached to a bed and in use in connection with a wheelchair, the disabled person being shown by phantom lines.

Although the disclosure hereof is detailed and exact to enable those skilled in the art to practice the invention, the physical embodiments herein disclosed merely exemplify the invention which may be embodied in other specific structure.

Referring more specifically to the drawings there is shown an assist device 10 of this invention in conjunction with a bed 30. Patient assist device 10 includes a planar base 12 which is provided with casters 14 attached to the bottom thereof. Preferably four casters are employed, but the use of a different number is contemplated to be within the scope of the invention. A support structure defined by vertical members 16, 17, 18, 19, 20 and 21 is provided for grasping by the disabled patient 28 to help the patient in rising to a standing position.

Planar surface 12 can be formed from any suitable materials such as plywood, fiberglass,plastic, metal etc. The support structure enclosing three sides of the base as shown can be formed preferably from tubular metal such as plated steel, anodized aluminum etc. As shown, one side 15 of the support structure is left open in order to allow for access to the device 10 by the patient 28.

Also, as seen, the support structure may have two lateral sides defined by bent or L-shaped tubing 20 and 21 on opposite sides and may have, opposite the open side 15, a closed side 22 which extends to a greater height than the lateral sides.

Figure 2:
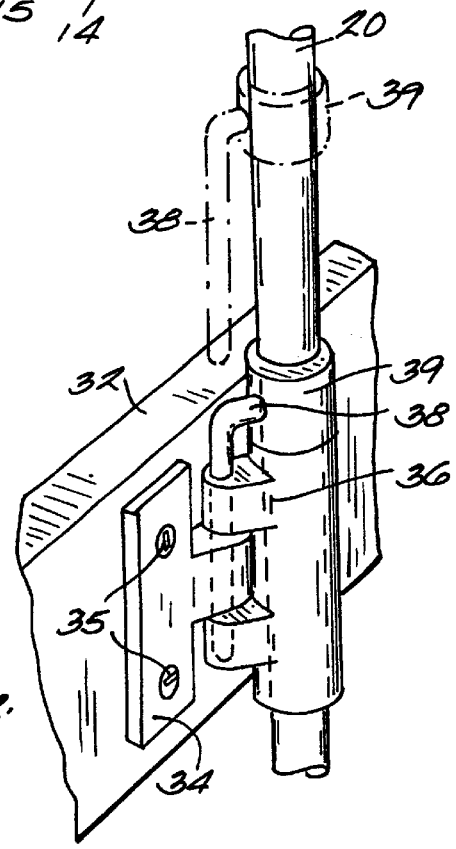
FIG. 2 is a fragmentary perspective view showing the pivotal connection of the device to a bed frame with a disengaged position of the pivot pin shown by means of phantom lines.

The releasable arrangement for pivotally connecting the device 10 to a bed 30 is best seen in FIG. 2. A first hinge component 34 is secured to bed frame member 32 by means of appropriate fasteners such as screws or bolts 35. A second hinge component 36 is fixed to a vertical member 20 of the assist device 10. Component 36 can be fastened, for example, by means of a set screw (not shown) which makes possible the vertical adjustment of the second component 36 relative to the first component 34. In order to form a releasable pivot connection a pin 38 is provided. This is conveniently carried on a collar 39 which is slidable vertically along the vertical element 20 as noted by phantom lines in FIG. 2.

It is also contemplated that a hinge component 37 can be attached to vertical member 21 which is adjacent to the other lateral side adjacent to the open side 15 of the base 12. The use of such a second hinge element enables use of the device 10 in situations where more than one bed is located in a single room, as is common in many hospital and nursing home situations. Thus, if the bed 30 is parallel to another bed (not shown), a single assist device 10 can be used to assist patients who are sharing a room. It will be readily apparent that the device 10 can be disengaged from bed 30 by sliding the collar upward removing the pin 38 from the two hinge components 34 and 36 thus allowing the device 10 to be rolled on the casters 14 over the floor toward the second bed. The connection and manipulation of the device 10 on the other bed would be a mirror image of the steps illustrated in FIGS. 3–5.

Figure 4:
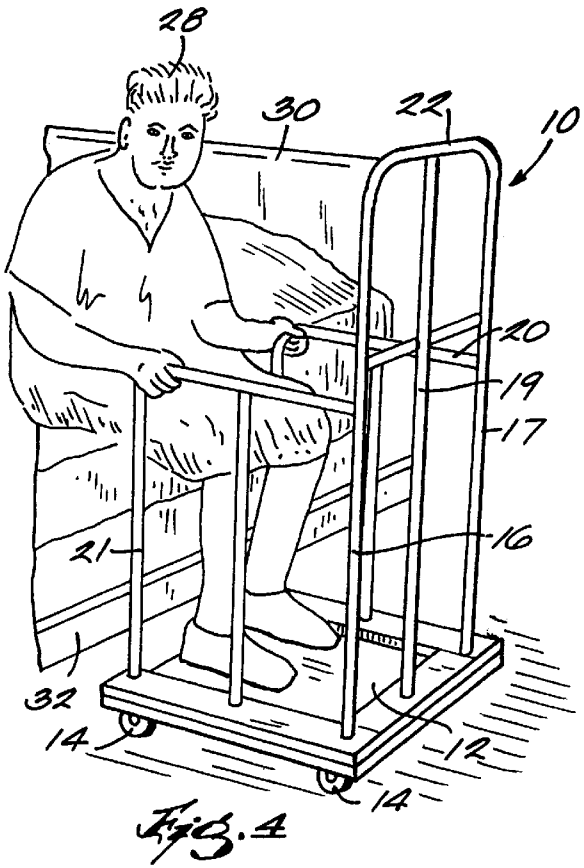
FIG. 4 is a perspective fragmentary view of the device of this invention pivoted into position facing a bed with a patient shown seated for transfer into the device.
Figure 3:
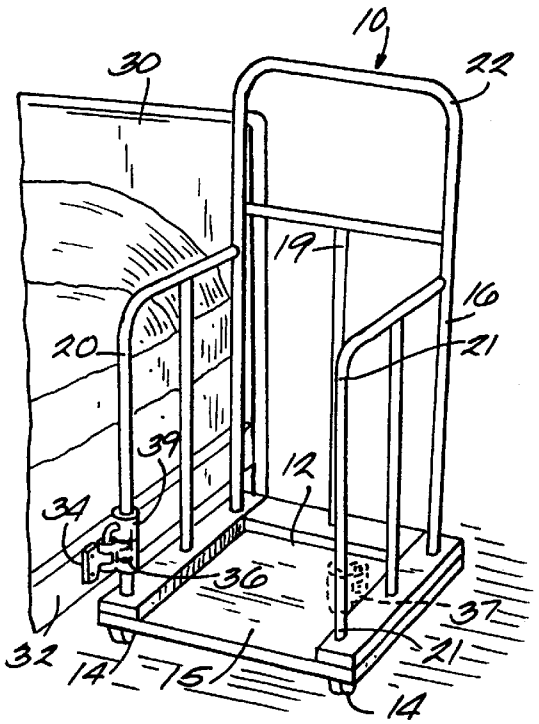
FIG. 3 is a fragmentary perspective view showing a device of this invention connected to a bed frame in a stand-by position and showing an alternative connection hinge for use with a different bed, shown by phantom lines.

As seen in FIG. 4 the device 10 is pivoted 90 degrees from the position shown in FIG. 3 to enable the patient 28, shown seated on the edge of the bed 30, to have access to the device 10. Also as seen in FIG. 4, the bent tops of the vertical members 20 and 21 are conveniently used by the patient 28 to assist in rising to a standing position. The fact that the device 10 is pivotally connected to the bed 30 by the hinge components 34 and 36 greatly stabilizes the device. Thus even a heavy individual can rise up in the device 10 which, being attached to the bed 30, is not free to tip even if the patient 28 is unsteady in attempting to stand as is often the case. Structure 10 includes various frame elements 17 and 19 as well as a raised top section on closed side 22, integral with of the vertical members 16 and 17, all of which can conveniently be used by the patient.

It will be understood that the particular arrangement of vertical and cross-members is shown for purposes of illustration rather than limitation, as numerous other arrangements are equally functional.

Figure 5:
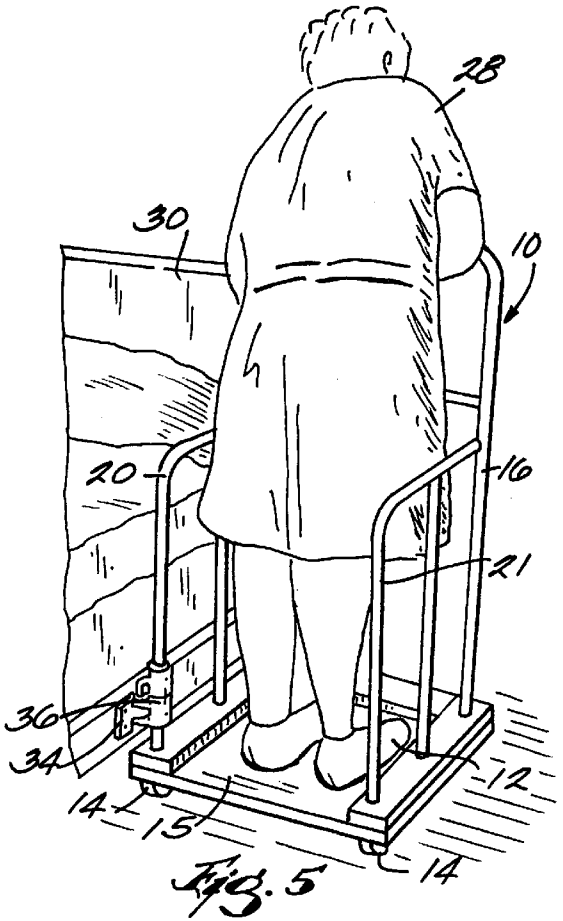
FIG. 5 shows the device of FIG. 4 after the disabled person has assumed a standing position on the device which has been pivoted away from the bed for use in connection with a wheelchair.

Referring to FIG. 5 it is seen that once the patient 28 is standing on the platform 12 of device 10 the device is pivoted ninety degrees so that the open side 15 is accessible. Then a wheelchair 40, for example, can be wheeled up to the open side 15 and the patient 28 can conveniently sit in the wheelchair 40 for purposes of transportation for example to a dining table, lavatory or other location. It will also be apparent that by raising the collar 39 and disengaging the pin 38 that device 10, itself, can be used as a means for transporting the patient to another one of the available locations simply by rolling movement of casters 14 over the floor surface. Accordingly, the device of the present invention is seen to be extremely versatile in types of assistance made available to a patient or disabled person 28.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A device for assisting a disabled person to rise to a standing position comprising:

a planar base having opposed upper and lower surfaces;

a plurality of casters attached to said bottom surface to enable rolling movement of said assist device across a floor;

a support structure extending vertically from the upper surface of said base being defined by a plurality of vertical members and at least one horizontal member connecting said vertical members, said support structure being closed on three sides and open on a fourth side;

a pair of mating hinge components, a first one of said hinge components being affixed to a vertical member of said support structure adjacent to the open side of said structure;

said second hinge component being attachable to a bed frame at a height adapted to receive said mating first hinge component and an pin adapted to removably pivotally connect said first and second hinge components;

said device being pivotable from a position facing said bed for access of a disabled person thereto and being pivotable ninety degrees to enable egress of said disabled person therefrom.

2. A device according to claim 1 wherein a side of said support structure opposite said fourth side extends to a greater vertical height than do the other two of said three sides.

3. A device according to claim 1 wherein a hinge component is provided adjacent each side of said fourth side.

4. A device according to claim 1 wherein said pin is carried by a sleeve slidably mounted on a vertical member of said support structure.

* * * * *